US007987856B2

(12) United States Patent
Gedevanishvili et al.

(10) Patent No.: US 7,987,856 B2
(45) Date of Patent: Aug. 2, 2011

(54) SMOKING ARTICLE WITH BYPASS CHANNEL

(75) Inventors: Shalva Gedevanishvili, Richmond, VA (US); Mohammad R. Hajaligol, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 729 days.

(21) Appl. No.: 11/643,868

(22) Filed: Dec. 22, 2006

(65) Prior Publication Data

US 2007/0169785 A1 Jul. 26, 2007

Related U.S. Application Data

(60) Provisional application No. 60/754,315, filed on Dec. 29, 2005.

(51) Int. Cl.
*A24D 3/06* (2006.01)

(52) U.S. Cl. ..... 131/339; 131/360; 131/361; 131/211; 131/73; 131/341; 131/344

(58) Field of Classification Search ..... 131/339, 131/360
See application file for complete search history.

(56) References Cited

U.S. PATENT DOCUMENTS

| | | | | |
|---|---|---|---|---|
| 2,592,553 | A | 4/1952 | Frankenburg et al. | |
| 2,592,554 | A | 4/1952 | Frankenburg | |
| 2,598,680 | A | 6/1952 | Frankenburg | |
| 2,769,734 | A | 11/1956 | Bandel | |
| 2,954,772 | A | 10/1960 | Lebert | |
| 2,954,778 | A | 10/1960 | Lebert | |
| 2,954,783 | A | 10/1960 | Lebert | |
| 2,954,786 | A | 10/1960 | Lebert | |
| 3,098,492 | A | 7/1963 | Wurzburg et al. | |
| 3,236,244 | A | 2/1966 | Irby, Jr. et al. | |
| 3,242,925 | A * | 3/1966 | Sterne | 131/338 |
| 3,255,760 | A | 6/1966 | Selke | |
| 3,283,762 | A | 11/1966 | Kissel | |
| 3,318,312 | A | 5/1967 | Curtis, Jr. | |
| 3,356,094 | A | 12/1967 | Ellis et al. | |
| 3,395,713 | A | 8/1968 | Ent-Keller | |

(Continued)

FOREIGN PATENT DOCUMENTS

BE 679657 A 10/1966

(Continued)

OTHER PUBLICATIONS

Written Opinion dated Aug. 5, 2004 for International Application No. PCT/US04/04530.

(Continued)

*Primary Examiner* — Philip C Tucker
*Assistant Examiner* — Vicki Wu
(74) *Attorney, Agent, or Firm* — Buchanan Ingersoll & Rooney PC

(57) ABSTRACT

A smoking article having a tobacco rod of a smokable material and a filter system attached to the tobacco rod of smokable material. The filter system includes a first filter portion and a second filter portion, the second filter portion concentrically positioned with respect to the first filter portion and having a lower resistance to draw than the first filter portion during an initial puff on the smoking article. The second filter portion closes upon contact with the mainstream smoke of the initial puff, such that after the initial puff, the first filter portion has the lower resistance to draw.

16 Claims, 4 Drawing Sheets

U.S. PATENT DOCUMENTS

| | | | | |
|---|---|---|---|---|
| 3,457,927 | A | | 7/1969 | Siragusa |
| 3,496,945 | A | | 2/1970 | Tomkin |
| 3,581,748 | A | | 6/1971 | Cameron |
| 3,637,447 | A | | 1/1972 | Berger et al. |
| 3,648,712 | A | | 3/1972 | Patterson |
| 3,685,522 | A | | 8/1972 | Kleinhans |
| 3,738,375 | A | | 6/1973 | Doumas |
| 3,756,249 | A | | 9/1973 | Selke et al. |
| 3,759,270 | A | | 9/1973 | Wright |
| 3,860,011 | A | | 1/1975 | Norman |
| 3,931,824 | A | | 1/1976 | Miano et al. |
| 3,968,804 | A | | 7/1976 | Kelly et al. |
| 3,986,515 | A | | 10/1976 | Egri |
| 4,016,887 | A | | 4/1977 | Uroshevich |
| 4,022,222 | A | | 5/1977 | Berger |
| 4,091,821 | A | | 5/1978 | Scorzo |
| 4,119,105 | A | | 10/1978 | Owens, Jr. |
| 4,120,310 | A | | 10/1978 | Lee et al. |
| 4,135,523 | A | | 1/1979 | Luke et al. |
| 4,182,349 | A | | 1/1980 | Selke |
| 4,186,756 | A | | 2/1980 | Takemoto et al. |
| 4,197,863 | A | | 4/1980 | Clayton et al. |
| 4,256,122 | A | | 3/1981 | Johnson |
| 4,256,126 | A | | 3/1981 | Seligman et al. |
| 4,273,141 | A | | 6/1981 | Jan Van Tilburg |
| 4,292,983 | A | | 10/1981 | Mensik |
| 4,340,072 | A | | 7/1982 | Bolt et al. |
| 4,341,228 | A | | 7/1982 | Keritsis et al. |
| 4,357,950 | A | | 11/1982 | Berger |
| 4,380,241 | A | | 4/1983 | Horsewell |
| 4,386,618 | A | | 6/1983 | Cantrell |
| 4,421,126 | A | | 12/1983 | Gellatly |
| 4,460,001 | A | | 7/1984 | Browne et al. |
| 4,469,112 | A | | 9/1984 | Browne et al. |
| 4,508,525 | A | | 4/1985 | Berger |
| 4,515,170 | A | | 5/1985 | Cantrell et al. |
| 4,542,755 | A | | 9/1985 | Selke et al. |
| 4,564,030 | A | | 1/1986 | Jessup et al. |
| 4,574,820 | A | | 3/1986 | Pinkerton et al. |
| 4,585,015 | A | | 4/1986 | Silberstein |
| 4,622,982 | A | | 11/1986 | Gaisch et al. |
| 4,637,409 | A | | 1/1987 | Berger |
| 4,649,944 | A | | 3/1987 | Houck, Jr. et al. |
| 4,660,579 | A | | 4/1987 | Horsewell et al. |
| 4,677,992 | A | | 7/1987 | Bliznak |
| 4,687,008 | A | | 8/1987 | Houck, Jr. et al. |
| 4,700,726 | A | | 10/1987 | Townsend et al. |
| 4,732,168 | A | | 3/1988 | Resce et al. |
| 4,754,766 | A | | 7/1988 | Luke et al. |
| 4,784,632 | A | | 11/1988 | Berger |
| 4,793,365 | A | | 12/1988 | Sensabaugh et al. |
| 4,867,182 | A | * | 9/1989 | Roberts et al. ..... 131/339 |
| 4,896,682 | A | | 1/1990 | Liew |
| 4,924,886 | A | | 5/1990 | Litzinger |
| 4,942,887 | A | * | 7/1990 | Abdelgawad et al. ..... 131/336 |
| 4,962,774 | A | | 10/1990 | Thomasson et al. |
| 4,972,853 | A | | 11/1990 | Brackmann et al. |
| 4,972,854 | A | | 11/1990 | Kiernan et al. |
| 4,984,588 | A | | 1/1991 | Stewart, Jr. |
| 5,046,514 | A | | 9/1991 | Bolt |
| 5,050,621 | A | | 9/1991 | Creighton et al. |
| 5,058,608 | A | | 10/1991 | Henning et al. |
| 5,060,676 | A | | 10/1991 | Hearn et al. |
| 5,074,319 | A | | 12/1991 | White et al. |
| 5,099,864 | A | | 3/1992 | Young et al. |
| 5,101,839 | A | | 4/1992 | Jakob et al. |
| 5,105,836 | A | | 4/1992 | Gentry et al. |
| 5,105,838 | A | | 4/1992 | White et al. |
| 5,129,408 | A | | 7/1992 | Jakob et al. |
| 5,178,166 | A | | 1/1993 | Newsome et al. |
| 5,190,061 | A | | 3/1993 | Brackmann et al. |
| 5,203,354 | A | | 4/1993 | Hickle |
| 5,360,023 | A | | 11/1994 | Blakley et al. |
| 5,392,792 | A | | 2/1995 | Banerjee et al. |
| 5,392,793 | A | | 2/1995 | Molloy |
| 5,435,326 | A | | 7/1995 | Gentry et al. |
| 5,458,107 | A | | 10/1995 | Balogh et al. |
| 5,524,647 | A | | 6/1996 | Brackmann |
| 5,533,530 | A | | 7/1996 | Young et al. |
| 5,568,819 | A | | 10/1996 | Gentry et al. |
| 5,584,306 | A | | 12/1996 | Beauman et al. |
| 5,598,868 | A | | 2/1997 | Jakob et al. |
| 5,666,976 | A | | 9/1997 | Adams et al. |
| 5,690,127 | A | * | 11/1997 | Chapman et al. ..... 131/364 |
| 5,709,227 | A | * | 1/1998 | Arzonico et al. ..... 131/341 |
| 5,715,844 | A | | 2/1998 | Young et al. |
| 5,724,998 | A | | 3/1998 | Gellatly et al. |
| 5,727,571 | A | | 3/1998 | Meiring et al. |
| 5,743,251 | A | | 4/1998 | Howell et al. |
| 5,746,230 | A | | 5/1998 | Arterbery et al. |
| 5,839,449 | A | | 11/1998 | Banerjee et al. |
| 5,954,061 | A | | 9/1999 | Cardarelli |
| 6,089,238 | A | | 7/2000 | Schneider et al. |
| 6,216,706 | B1 | | 4/2001 | Kumar et al. |
| 6,257,242 | B1 | | 7/2001 | Stavridis |
| 6,584,979 | B2 | | 7/2003 | Xue et al. |
| 6,718,989 | B1 | | 4/2004 | Clarke et al. |
| 6,761,174 | B2 | | 7/2004 | Jupe et al. |
| 6,779,529 | B2 | | 8/2004 | Figlar et al. |
| 6,814,786 | B1 | | 11/2004 | Zhuang et al. |
| 6,823,873 | B2 | | 11/2004 | Nichols et al. |
| 6,883,516 | B2 | | 4/2005 | Hindle et al. |
| 6,883,523 | B2 | | 4/2005 | Dante |
| 2002/0166561 | A1 | * | 11/2002 | Sinclair, Jr. ..... 131/73 |
| 2003/0200973 | A1 | | 10/2003 | Xue et al. |
| 2004/0025890 | A1 | | 2/2004 | Yen |
| 2004/0159327 | A1 | | 8/2004 | Dante |
| 2004/0261807 | A1 | | 12/2004 | Dube et al. |
| 2005/0066980 | A1 | | 3/2005 | Crooks et al. |
| 2005/0066981 | A1 | | 3/2005 | Crooks et al. |
| 2006/0201524 | A1 | * | 9/2006 | Zhang et al. ..... 131/207 |
| 2007/0181140 | A1 | * | 8/2007 | Xue et al. ..... 131/211 |
| 2007/0186945 | A1 | | 8/2007 | Olegario et al. |
| 2007/0235050 | A1 | | 10/2007 | Li et al. |
| 2007/0261706 | A1 | | 11/2007 | Banerjea et al. |
| 2008/0017204 | A1 | | 1/2008 | Braunshteyn et al. |
| 2008/0047571 | A1 | | 2/2008 | Braunshteyn et al. |
| 2008/0163877 | A1 | | 7/2008 | Zhuang et al. |
| 2008/0216848 | A1 | | 9/2008 | Li et al. |
| 2008/0216851 | A1 | | 9/2008 | Olegario et al. |

FOREIGN PATENT DOCUMENTS

| | | | | |
|---|---|---|---|---|
| BE | 1000454 | A4 | | 12/1988 |
| DE | 3439861 | A1 | | 5/1985 |
| EP | 0077123 | A2 | | 4/1983 |
| EP | 0212879 | A1 | | 3/1987 |
| EP | 0364256 | A1 | | 4/1990 |
| EP | 0471 581 | A1 | | 2/1992 |
| EP | 0482 872 | A1 | | 4/1992 |
| EP | 0568107 | A | | 11/1993 |
| EP | 0481596 | B1 | | 1/1994 |
| FR | 2481581 | | | 11/1981 |
| GB | 1058342 | A | | 2/1967 |
| GB | 1228747 | | | 4/1971 |
| GB | 1256154 | | | 12/1971 |
| GB | 1 428 018 | | | 3/1976 |
| GB | 1428018 | A | * | 3/1976 |
| GB | 2100573 | A | | 1/1983 |
| GB | 2149287 | A | | 6/1985 |
| GB | 2177890 | A | * | 2/1987 |
| GB | 2177890 | A | | 2/1987 |
| WO | WO 90/09741 | A | | 9/1990 |
| WO | WO 99/26495 | A | | 6/1999 |
| WO | WO00/00047 | | | 1/2000 |
| WO | WO 02/03819 | A | | 1/2002 |
| WO | WO 2006/070289 | A | | 7/2006 |
| WO | WO2006082529 | A | | 8/2006 |
| WO | WO2007/093757 | A1 | | 8/2007 |
| WO | WO2007/110650 | A1 | | 10/2007 |

OTHER PUBLICATIONS

International Search Report dated Aug. 5, 2004 for PCT/US04/04530.

Invitation to Pay Additional Fees and Annex to Form PCT/ISA/206 Communication Relating to the Results of the Partial International Search dated Oct. 16, 2007 for International Application No. PCT/IB2006/004209.

International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Search Report and Written Opinion dated Oct. 19, 2007 for PCT/IB2006/004202.
International Preliminary Report on Patentability mailed Jul. 9, 2009 for PCT/IB2007/004503.
International Search Report and Written Opinion dated Mar. 17, 2008 for PCT/IB2006/004209.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 7, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.

* cited by examiner

SMOKING ARTICLE WITH BYPASS CHANNEL

CROSS-REFERENCE TO RELATED APPLICATION

This application claims priority to U.S. Patent Provisional Application No. 60/754,315, filed Dec. 29, 2005, which is incorporated herein by this reference in its entirety.

BACKGROUND

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally about 7.0 and 10.0 millimeters in diameter and 60 millimeters and 125 millimeters in length.

Typically, the filter includes a plug of cellulose acetate tow attached to the tobacco rod by tipping paper. Ventilation of mainstream smoke can be achieved with a row or rows of perforations about a location along the filter. In addition, activated carbon can be added to the filter to remove many gas phase components from the smoke. Unfortunately, American smokers perceive a taste deficit with carbon-filter cigarettes.

SUMMARY

It would be desirable for a smoking article that provides an acceptable flavor during the first puff or puffs and thereafter directs the mainstream smoke through a carbonaceous and/or highly ventilated filter portion.

In accordance with one embodiment, a smoking article comprises: a tobacco rod of a smokable material; and a filter system attached to the tobacco rod of smokable material, the filter system comprising: a first filter portion and a second filter portion, the second filter portion concentrically positioned with respect to the first filter portion and having a lower resistance to draw than the first filter portion during an initial puff on the smoking article, and wherein the second filter portion closes upon contact with mainstream smoke contained within smoke from the tobacco rod during the initial puff on the smoking article.

In accordance with another embodiment, a smoking article comprises: a tobacco rod of a smokable material; and a filter system attached to the tobacco rod, the filter system comprises a central filter portion of a low resistance material and a main filter portion, the central filter portion having a lower resistance to draw than the main filter portion, and wherein during an initial puff on the smoking article, smoke is drawn predominantly through the central filter portion, and wherein the central filter portion closes upon contact with mainstream smoke from the initial puff, such that smoke is drawn predominantly through the main filter portion.

In accordance with a further embodiment, a method of making a smoking article, comprises: forming a tobacco rod of smokable material; forming a filter system of the smoking article having a first filter portion and a second filter portion, wherein the second filter portion is concentrically positioned with respect to the first filter portion and has a lower resistance to draw than the first filter portion during an initial puff on the smoking article, wherein the second filter portion closes upon contact with mainstream smoke from the tobacco rod during the initial puff on the smoking article such that the first filter portion has the lower resistance to draw after the initial puff; and joining said tobacco rod portion in end-to-end relationship with said filter system.

DETAILED DESCRIPTION

Figure 1:
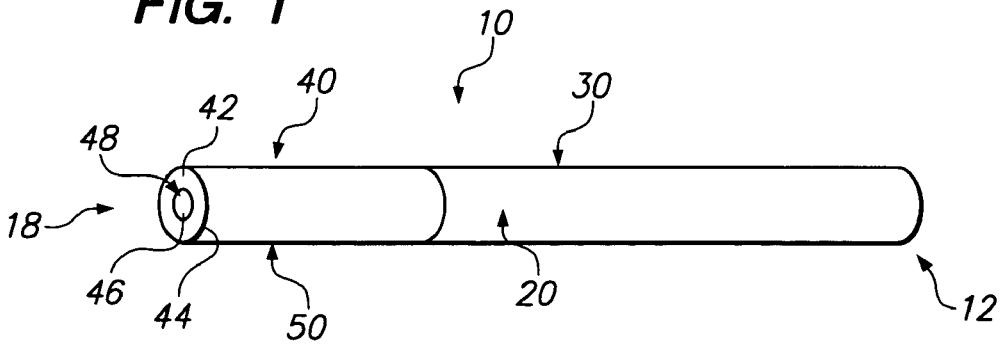
FIG. 1 shows a perspective view of a smoking article with a low resistance bypass channel in the filter system.

FIG. 1 shows a perspective view of a smoking article 10 in the form of a cigarette having a central (core) or second filter portion or low resistance filter portion 46, which forms a bypass channel 48 for smoke from the first puff. The bypass channel 48 delivers a mainstream smoke at the initiation of smoking that at least in substantial part, has not contacted any activated carbon and is therefore without the taste deficits commonly associated with carbon-filter cigarettes by American smokers. Following the first or initial puff on the smoking article 10, the bypass channel 48 preferably gels (or collapses) after contact with moisture contained in the smoke, to thereby close the bypass channel 48. By the second or subsequent puff, the central filter or second filter portion or low resistance filter portion 46 will be blocked and the smoke will be drawn through a first filter portion 42 containing a carbonaceous material or other filter adsorbent or catalyst materials.

Figure 2:
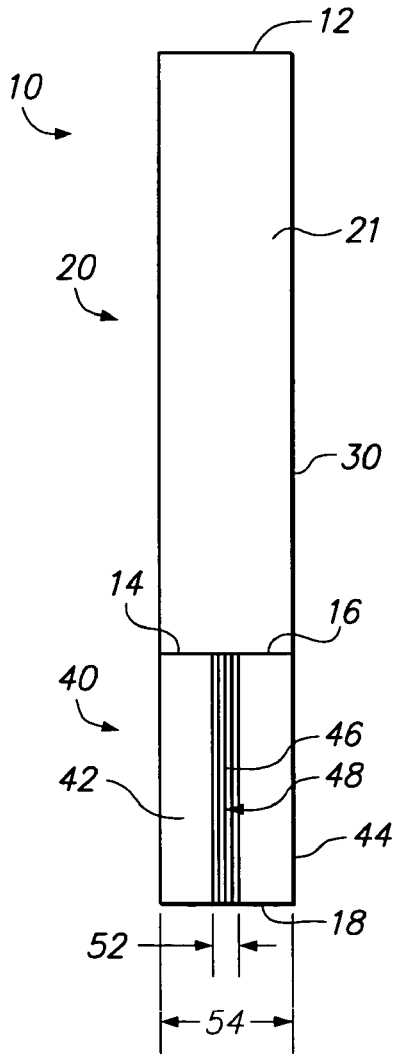
FIG. 2 shows a cross sectional view of the smoking article of FIG. 1 with the low resistance bypass channel in the filter system.

As shown in FIG. 1, smoking articles 10 in the form of cigarettes typically include a generally cylindrical rod 20 of smokable material 21 (FIG. 2), contained in a circumscribing outer wrapper 30. The outer wrapper 30 is typically a porous wrapping material or paper wrapper. The rod 20 is typically referred to as a "tobacco rod" and has a lit end 12 and a tipped end 14 (FIG. 2). The smokable material 21 is preferably a shredded tobacco or tobacco cut filler. However, any suitable smokable material 21 can be used.

The smoking article 10 also includes a filter system 40 adjacent to the tipped end 14 of the tobacco rod 20 such that the filter system 40 and tobacco rod 20 are axially aligned in an end-to-end relationship, preferably abutting one another. The filter system 40 has a generally cylindrical shape, and the diameter thereof is essentially equal to the diameter of the tobacco rod 20.

The filter system 40 includes a main filter portion or first filter portion 42 of preferably carbonaceous material such as charcoal, carbon-on-tow, carbon or other adsorbent or catalyst materials circumscribed by a plug wrap 44. It can be appreciated that the first filter portion 42 can be a starch-based, polypropylene, or plasticized cellulose acetate tow, filter paper or other suitable material. The first filter portion 42 material also can have the form of a gathered web (e.g., polypropylene web, polyester web, cellulosic web or starch-based web). The plug wrap 44 is a paper which optionally may incorporates a carbonaceous material. The plug wrap 44 preferably circumscribes the total length of the filter system 40.

As shown in FIG. 1, the filter system 40 further comprises a second filter portion 46 of low resistance to draw or central filter forming a bypass channel 48 for smoke generated during a first puff on the smoking article 10. During initial puff or puffs, the second filter portion 46 forms the bypass channel 48 and delivers a mainstream smoke that at least in substantial part, has not contacted any activated carbon and is therefore without the taste deficits commonly associated with carbon-filter cigarettes by American smokers. Thereafter, the filter system 40 directs the mainstream smoke into contact with activated carbon to achieve smoke constituent reduction.

The filter system 40 is attached to the tobacco rod 20 by a tipping material 50, which circumscribes both the entire length of the filter system 40 and an adjacent region of the tobacco rod 20. The tipping material 50 is typically a paper like product; however, any suitable material can be used. A ventilated or air diluted smoking article is provided with an air dilution means, such as a series of ventilation holes or perforations (not shown), each of which extend through the tipping material 50 and optionally, also the plug wrap 44.

FIG. 2 shows a cross sectional view of an embodiment of the smoking article 10 of FIG. 1 having a tobacco rod 20 and filter system 40 with a bypass channel 48. The lit end 12 of the smoking article 10 is comprised of a cylindrical tobacco rod 20 that is preferably about 7.0 and 10.0 millimeters in diameter and 60 millimeters and 125 millimeters in length. It can be appreciated that the diameter and width of the tobacco rod 20 can vary for different smoking articles 10.

As shown in FIG. 2, the filter system 40 comprises a central or second filter portion 46, which is coaxially or concentrically positioned within the first filter portion 42 of the filter system 40. The second filter portion 46 preferably extends from the upstream end 16 to the buccal (mouth) end 18 of the filter system 40. The second filter portion 46 is preferably a small diameter whistle through product such as a free-flow filter (also known in the art as "whistle-through"), which provides structural definition and permits aerosols (mainstream smoke) to be drawn from the interior of the tobacco rod 20 with a minimum pressure drop. Alternatively, the second filter material can be a low resistance filter material, which is placed in the center of the first filter portion 42 of the filter system 40.

The filter system 40 is preferably about 7.0 and 10.0 millimeters in diameter 54 with the second filter portion 46 having a diameter 52 of about 0.1 to 5.0 millimeters and more preferably about 2.0 and 2.5 millimeters. Furthermore, the resistance or resistance-to-draw (RTD) of the second filter portion 46 will preferably be less than the resistance-to-draw of the first filter portion 42, such that during a first puff on the smoking article 10, more of the smoke from the tobacco rod 20 is drawn through the second filter portion 46 rather than the first filter portion 42.

The second filter portion 46 is preferably inserted into a first filter portion 42, which may contain activated carbon or other adsorbent or a catalyst. During an initial puff or puffs, mainstream smoke is drawn from the lit end 12 through the tobacco rod 20 to the downstream end 18 of the filter system 40. The smoke is drawn through the bypass channel 48 formed by the second filter portion 46 due to its low resistance to draw. In addition, it is desirable that the second filter portion 46 is comprised of a material, which will gel (or collapse) after contact with the moisture contained in the smoke thereby obstructing, clogging or otherwise closing the second filter portion 46. Thus, by the time of the second puff (or optionally second, third, or later puffs) on the smoking article 10, the second filter portion 46 will be partially or totally blocked and the mainstream smoke will be drawn through the first filter portion 42. In one embodiment, the first filter portion 42 is a carbonaceous or activated carbon loaded filter system. It can be appreciated that the first filter portion 42 can include an activated carbon material mixed with a cellulose acetate material (also know as carbon-on-tow). The second filter portion 46 can be comprised of any suitable nano or micron-size filter material, which gels or wets in reaction to the moisture from the mainstream smoke. Preferably, if nano or micron-size fiber materials are used, the fibers are in the range of about 10 to 50 microns. The fiber materials may comprise a super absorbent material. In addition, it can be appreciated that in accordance with one embodiment, the second filter portion 46 does not include a tubular segment or wrapping of a heat-shrink material (or heat-deformable material).

Figure 3:
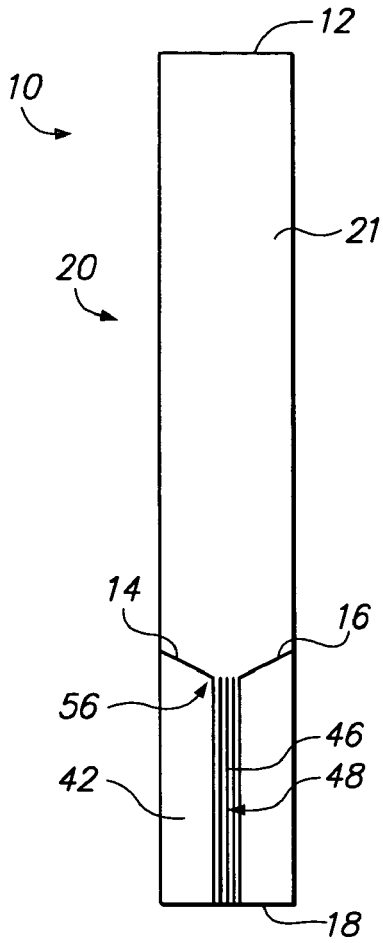
FIG. 3 shows a cross sectional view of another aspect of the smoking article of FIG. 1 with a low resistance bypass channel and having a funnel shaped portion at the mouth end of the filter system.

FIG. 3 shows an alternative embodiment of a smoking article 10 having a bypass channel 48. As shown in FIG. 3, the smoking article 10 comprises a filter system 40 having a first filter portion 42 with a second filter portion 46 concentrically positioned within the first filter portion 42. The upstream end 16 of the filter system 40 has a funnel 56, which directs smoke through the second filter portion 46 during the first puff. The funnel 56 is preferably made from a low permeability paper, which will disintegrate after the first puff, allowing mainstream smoke from the tobacco rod 20 to be drawn into the first filter portion 42 of the filter system 40. It can be appreciated that the second filter portion 46 can be a collapsible filter material, or a hollow paper tube neck 45 (FIGS. 8A-8F) can be made between the filter system 40 and the funnel 56, which will work in the same manner as shown in FIGS. 8A-8F to form a paper lid or flap valve. As shown in FIGS. 8A-8F, the hollow paper tube neck 45 blocks the second filter portion 46 by forming a cover or lid to the second filter portion 46.

Figure 4:
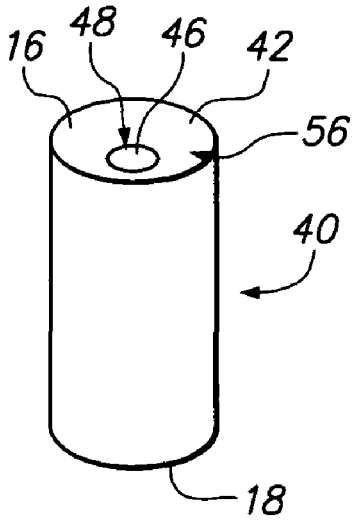
FIG. 4 shows a perspective view of the filter system of FIG. 3.

FIG. 4 shows a perspective view of the filter system 40 of FIG. 3 having the funnel 56 on the upstream end 16 of the filter system 40. As shown in FIG. 4, the filter system 40 comprises the first filter portion 42 with is concentrically positioned around the second filter portion 46 forming the bypass channel 48 as a result of the lower resistance to draw of the second filter portion 46 as compared to the resistance to draw of the first filter portion 42. The funnel 56 directs the smoke from the tobacco rod 20 to the second filter portion 46.

Figure 5:
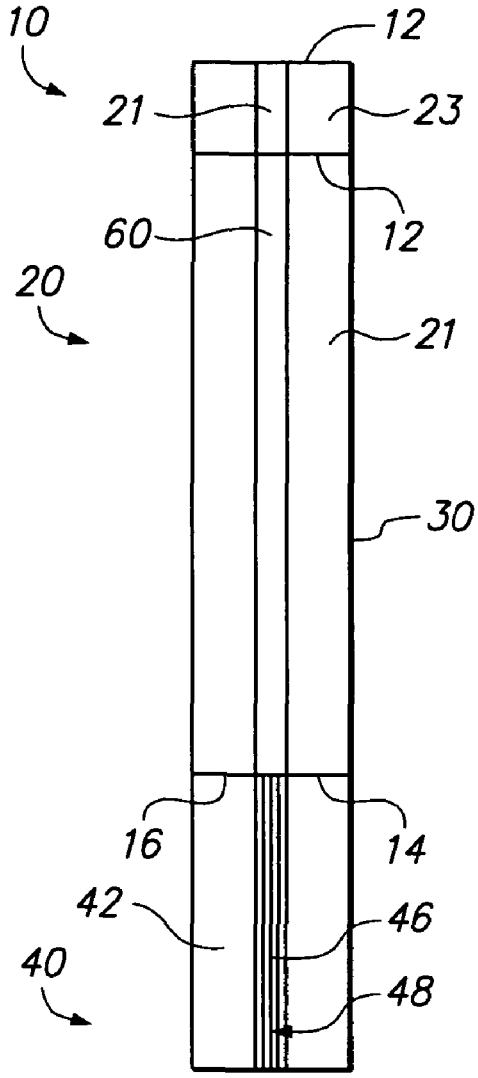
FIG. 5 shows a cross sectional view of a further aspect of the smoking article of FIG. 1, with a hollow tube configuration and a low resistance bypass channel in the filter system.

FIG. 5 shows another embodiment of a smoking article 10 having a tobacco rod 20 having a central hollow tube 60 and a filter system 40 with a bypass channel 48. As shown in FIG. 5, the smoking article 10 is comprised of a tobacco rod 20 and filter system 40. The tobacco rod 20 is comprised of a smoking material 21 having a central hollow tube 60, surrounded by a smokable material 21, preferably a tobacco filler material, and an outer layer of cigarette wrapper (paper) 30. The central tube 60 within the cylinder of smoking material 21 preferably extends all the way to the tipped end 14 of the tobacco rod 20 and abuts the upstream end 16 of the filter system 40. As shown, the tipped end 14 of the tube 60 is preferably aligned with and abuts the second filter portion 46 forming the bypass channel 48 of the filter system 40.

In addition, the lit end 12 of the central tube 60 of the tobacco rod 20 can be filled with a smokable material 21, which will be enough for the first puff. The lit end of the tube is preferably filled with a smokable material 21 for about 5 to 25 percent of a length of the tobacco rod 20. Around the above-mentioned smokable material 21, a filler loose tobacco or other suitable material 23 can be placed to maintain visual integrity of the smoking article 10. During the first puff, the smoke from the burned filler goes through the hollow tube 60 and bypass channel 48 of the filter system 40. After the first puff the moisture which passed through the hollow tube 60 softens and disintegrates the upstream end 16 of the second filter portion 46, which creates a lid for the bypass channel 48 and covers it during the second puff as shown in FIGS. 8A-8F. Alternatively, the bypass channel 48 can be adapted such that the upstream end 16 of the second filter portion 46 is adapted to collapse after the first puff.

Figure 6:
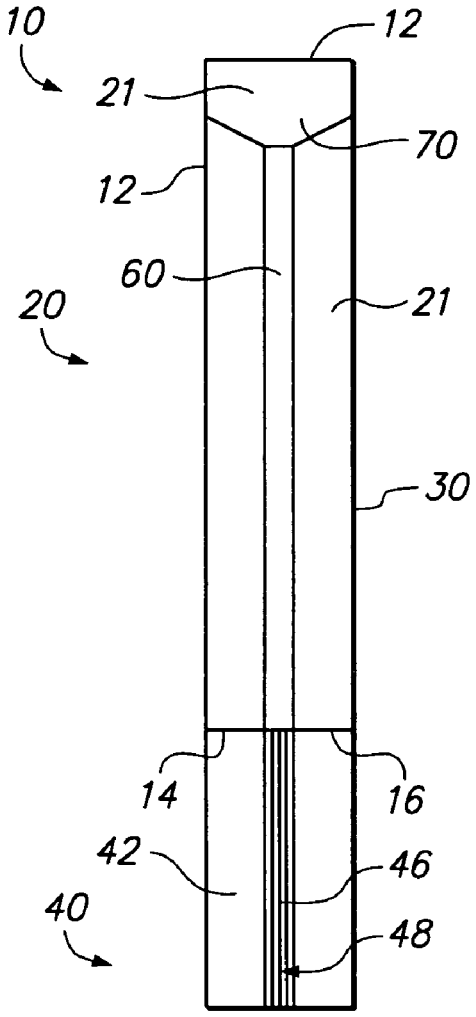
FIG. 6 shows a cross sectional view of another aspect of FIG. 1, with a hollow tube configuration and a funnel shaped portion at the lit end of the tobacco rod.

FIG. 6 shows an alternative embodiment of a smoking article having a tobacco rod 20 with a central hollow tube 60 wherein the lit end 12 is funnel shaped. As shown, the lit end 12 includes a funnel tip 70 adapted to direct smoke into the central hollow tube 60. As shown in FIG. 6, the smoking article 10 comprises a tobacco rod 20 comprised of a smoking material 21 having a central hollow tube 60, surrounded by tobacco filler material, and an outer layer of cigarette wrapper (paper) 30. The central tube 60 within the cylinder of smoking material 21 preferably extends all the way to the tipped end 14 of the tobacco rod 20 and abuts the upstream end 16 of the filter system 40. The downstream end of the tube 60 is preferably aligned with and abuts the second filter portion 46 forming the bypass channel 48 of the filter system 40.

As shown in FIG. 6, the lit end 12 of the tobacco rod 20 is preferably filled with a smokable material 21, which will be enough for a first puff. The tobacco rod 20 includes a conical surface in the form of a funnel tip 70 positioned on the lit end 12 of the hollow tube 60 of the tobacco rod 20. The funnel tip 70 directs the smoke from the first puff through the central hollow tube 60 and bypass channel 48. After the first puff, the funnel tip 70 burns thereby opening the tobacco rod 20. In addition, closure of the bypass channel 48 can be achieved by gelling or collapsing the second filter portion 46, or other suitable methods. The funnel tip 70 can be a paper material, a tobacco sheet or suitable material, which bums through during the first puff.

Figure 7:
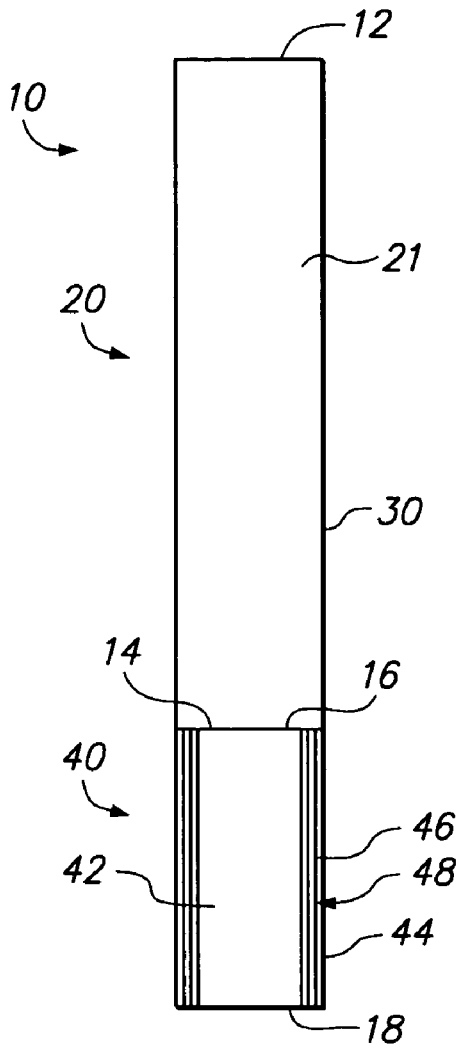
FIG. 7 shows a cross sectional view of another aspect of the smoking article of FIG. 1, with a low resistance bypass channel in the filter system.

FIG. 7 shows a cross sectional view of an alternative embodiment of a smoking article 10 comprised of a tobacco rod 20 and filter system 40. As shown in FIG. 7, the first filter portion 42 is coaxially or concentrically positioned within the second filter portion 46 of the filter system 40. The plug wrap 44 circumscribes the second filter portion 46 forming a bypass channel 48, in the form of an outer ring, between the plug wrap 44 and first filter portion 42. As described herein, the resistance or resistance-to-draw (RTD) of the second filter portion 46 will preferably be less than the resistance-to-draw of the first filter portion 42, such that during a first puff on the smoking article 10, more of the smoke from the tobacco rod 20 is drawn through the second filter portion 46 rather than the first filter portion 42. Furthermore, the second filter portion 46 is preferably comprised of a material, which will gel (or collapse) after contact with the moisture contained in the smoke thereby clogging the second filter portion 46.

Figures 8A, 8B, 8C, 8D, 8E, 8F:
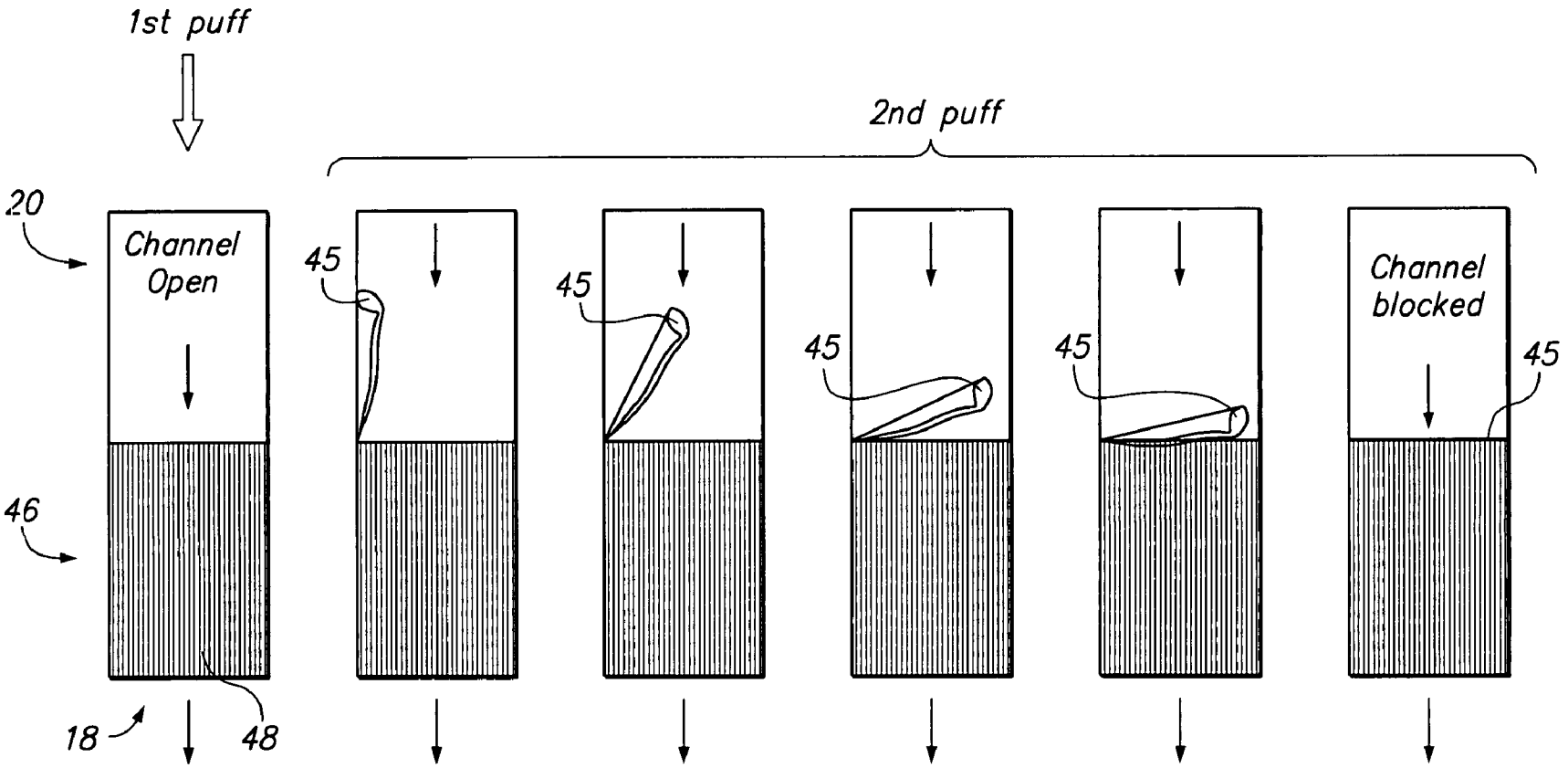
FIGS. 8A-8F show a schematic diagram of a bypass channel during the initial puff and subsequent puffs thereafter.

FIGS. 8A-8F show a schematic diagram of a bypass channel 48 during the initial puff and a subsequent puff. As shown in FIG. 8A, during the first puff, the bypass channel 48 is open and smoke from the tobacco rod 20 is drawn through the bypass channel 48 uninterrupted. FIGS. 8B-8F show the subsequent or second puff and the closing of the bypass channel 48 by use of a hollow paper tube neck 45 as the smoke from the tobacco rod 20 is drawn through the second filter portion 46 of the filter system 40. The hollow paper tube neck 45 acts as a lid or flap as it closes over the upstream entrance of the second filter portion 46. As shown in FIG. 8E, after the second puff (or optionally, after the second, third, or other initial puff), the bypass channel 48 is blocked from the closure of the hollow paper tube neck 45 over the second filter portion 46.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a tobacco rod of a smokable material; and a filter system attached to the tobacco rod of smokable material, the filter system comprising:

a first filter portion and a second filter portion, the second filter portion concentrically positioned with respect to the first filter portion, extending the entire length of the first filter portion and having a lower resistance to draw than the first filter portion during an initial puff on the smoking article, and wherein the second filter portion closes upon contact with mainstream smoke from the tobacco rod during the initial puff on the smoking article and wherein the second filter portion forms a gel upon contact with moisture contained within the mainstream smoke from the tobacco rod during the initial puff on the smoking article.

2. The smoking article of claim 1, wherein the filter system has an upstream end and a downstream end, and wherein the upstream end of the filter system has a funnel adapted to direct smoke through the second filter portion during the first puff.

3. The smoking article of claim 1, wherein the tobacco rod further comprises a central hollow tube extending from an upstream end of the tobacco rod to a juncture of the filter system.

4. The smoking article of claim 3, wherein the upstream end of the tube is filled with a smokable material.

5. The smoking article of claim 4, wherein the upstream end of the tube is filled with a smokable material for about 5 to 25 percent of a length of the tobacco rod.

6. The smoking article of claim 3, wherein the upstream end of the tube has a conical surface within the tobacco rod which directs smoke into the tube during the first puff.

7. The smoking article of claim 1, further comprising a lid on an upstream end of the second filter portion, and wherein the lid closes over the upstream end of the second filter portion after the first puff on the smoking article.

8. The smoking article of claim 7, wherein the first filter portion is a carbonaceous material.

9. The smoking article of claim 7, wherein the first filter portion contains an adsorbent material.

10. The smoking article of claim 7, wherein the first filter portion contains a catalyst material.

11. The smoking article of claim 1, wherein the first filter portion is coaxially positioned within the second filter portion.

12. A smoking article comprising:

a tobacco rod of a smokable material; and a filter system attached to the tobacco rod, the filter system comprises a central filter portion of a low resistance material and a main filter portion, the central filter portion having a lower resistance to draw than the main filter portion and extending the entire length of the main filter portion, and wherein during an initial puff on the smoking article, smoke is drawn predominantly through the central filter portion, wherein the central filter portion closes upon contact with mainstream smoke from the initial puff, such that smoke is drawn predominantly through the main filter portion, and wherein the central filter portion forms a gel upon contact with moisture contained within the mainstream smoke from the tobacco rod during the initial puff on the smoking article.

13. The smoking article of claim 12, wherein the main filter portion contains a carbonaceous material.

14. The smoking article of claim 12, wherein the main filter portion contains an adsorbent material.

15. The smoking article of claim 12, wherein the main filter portion contains a catalyst material.

16. A method of making a smoking article, comprising:

forming a tobacco rod of smokable material;

forming a filter system of the smoking article having a first filter portion and a second filter portion, wherein the second filter portion is concentrically positioned with respect to the first filter portion, extends the entire length of the first filter portion and has a lower resistance to draw than the first filter portion during an initial puff on the smoking article, wherein the second filter portion closes upon contact with mainstream smoke from the tobacco rod during the initial puff on the smoking article such that the first filter portion has the lower resistance to draw after the initial puff; and joining said tobacco rod portion in end-to-end relationship with said filter system, wherein the second filter portion forms a gel upon contact with moisture contained within the mainstream smoke from the tobacco rod during the initial puff on the smoking article.

* * * * *